US005351847A

United States Patent [19]

Greenbaum

[11] Patent Number: 5,351,847

[45] Date of Patent: Oct. 4, 1994

[54] SOLAMAR POTABLE WATER SYSTEM

[76] Inventor: George Greenbaum, 1005 N. Caribe Ave., Tucson, Ariz. 85710

[21] Appl. No.: 19,418

[22] Filed: Feb. 18, 1993

Related U.S. Application Data

[63] Continuation-in-part of Ser. No. 971,391, Nov. 4, 1992, abandoned.

[51] Int. Cl.[5] ..... B65D 7/00

[52] U.S. Cl. ..... 220/401; 220/461; 220/651; 220/608

[58] Field of Search ..... 220/401, 461, 608, 651; 4/487, 585, 586, 593; 184/106

[56] References Cited

U.S. PATENT DOCUMENTS 5,022,555 6/1991 Greenbaum ..... 220/401
5,033,232 7/1991 Vaughn ..... 220/401 X
5,065,890 11/1991 Greenbaum ..... 220/401

*Primary Examiner*—Steven M. Pollard
*Attorney, Agent, or Firm*—Samuels, Gauthier & Stevens

[57] ABSTRACT

A vessel which is comprised of a plurality of hollow structural members which are joined together by hollow fittings. The hollow members and fittings are filled with a material which sets after filling. An impermeable liner is received in the structure. The outside of the structure is wrapped with a thin film material to provide increased strength to the structure.

12 Claims, 7 Drawing Sheets

SOLAMAR POTABLE WATER SYSTEM

This is a continuation-in-part of copending U.S. patent application Ser. No. 07/971,391 filed on Nov. 4, 1992, now abandoned.

BACKGROUND AND SUMMARY OF THE INVENTION

The present invention relates to a low cost system for the fabrication of storage containers and the containers so formed.

Storage containers or vessels are usually fabricated from cast materials whether metal or plastic or they may be flexible containers with or without reinforcing. The following prior art is believed relevant to the present disclosure. U.S. Pat. Nos. 3,657,042; 4,277,688; 3,875,723; 4,353,763, 4,132,050; 4,409,776; 2,260,064; 4,451,739; European Patent No. 0072429; and my earlier issued U.S. Pat. Nos. 5,022,555 and 5,065,890.

There is a need for a vessel, container, tank or related structure that has low cost, ease of on site fabrication and particularly, a highly custom tailored construction to match demanding specifications.

Broadly, the invention is directed to structural improvements of the containers disclosed in my above-referenced patents, which patents are incorporated by reference in their entireties into this disclosure.

An object of the invention is fabricating vessels with a wide range of dimensions. The vessels may be small enough to accomodate as little as 50 gallons of water (or liquid) when used as a storage container or as large as a unit of which could be 65 feet high with a cross-section of 20 feet by 20 feet when it is utilized as a vessel to hold land fill wastes.

When the vessel is used to support wastes they are digested or decomposed by mixing the wastes with a microbial "soup" under either aerobic or anaerobic conditions to accelerate the decomposition process. Not only will the wastes be greatly reduced in volume but the waste will generate methane gas which can be used as fuel. The vessel is constructed with a heavy liner so that there will be no leakage. The top can be covered with a removable roof with an outlet to draw off effluent gases and odors.

In a preferred embodiment the digestive vessels will be part of a digester farm containing a multiple number of digesters. Typically, the digesters will be in various decomposition modes.

Generally the invention comprises hollow structural members which are joined together by hollow fittings. These members form a frame. When the frame is assembled with the hollow members and fittings, a hollow network of interconnected passageways is formed.

The members are secured to the fasteners by adhesives which either can be a mechanical adhesion or a chemical adhesion, such as cross-linking by polymerization. One can pick from a variety of thermoplastic, thermosetting resins to effect the bond.

This network of hollow passageways is filled with a material which will 'set' after filling, thus defining a soldified network which in combination with the members forms a frame of superior strength and rigidity. Received within the frame is a water impermeable liner, such as a plastic liner, to form a seamless vessel. The liner can extend over the top edge of the frame and downwardly over the outside of the frame. The outside of the frame is wrapped with a film material, such as stretch wrap or similar material, or simply bound with tape, such as a polypropylene tape.

In a preferred embodiment of the invention, where the vessel is used to store potable water, a specially designed cover is utilized to provide access to the vessel for introducing water into the vessel while minimizing evaporation from the vessel. Additionally, the frame of the cover is advantageously used.

Hardener filler materials include polymers, such as phenolics, urea-formaldehyde, styrene, styrene copolymers, acrylics, urethanes, vinyls, foams made from resins and polymers, aerated cement, concrete, wood flour mixes, synthetic or natural rubber, latex, molten sulphur, mixtures of rubber or rubber modified products with sulphur or other vulcanizing agents to create a group of strong and resilient cores in the network. Alternatively, a rubber can be extruded directly inside the pipe to form a so-called high durometer rubber product, making for an extremely resilient and strong plastic-rubber combination.

In a particularly preferred embodiment, reinforcing rods, such as Re-bars, steel or poltruded glass fiber bundles, are placed in the hollow network and then the settable material is poured into the passageways to improve the tensile and compressive strength of the frame.

Although in the preferred embodiment standard hollow cylindrical pipes will be connected by standard hollow fasteners, elbows, T-joints, etc., any hollow member can be used. These extruded members can be in any geometric configuration as long as they are hollow and function in combination with the other members to provide a member of increased strength. Other extruded profiles could include I-beams, T-beams, L-shaped structures, etc.

In a particularly preferred embodiment, in lieu of or in combination with standard hollow cylindrical pipes, the pipe is extruded such that the interior and/or exterior of the pipe is extruded in a profile such that the pipe has longitudinal grooves on its surface. These grooves greatly increased surface area over that of a smooth walled pipe so that when stress is applied it is more uniformly distributed thus increasing the resistance to compression/tension failure. When the hardener filler materials are introduced into the network in this type of configuration the greater surface area of the peaks and valleys of the grooves allows the introduction of more hardener material to create additional strength. Correspondingly, the fittings are extruded to mate with the grooved pipe.

Co-extruded members are also advantageous. For example, a member co-extruded with a PVC exterior shell could have a concentric high-impact styrene interior wall treated to have compatible adhesion surfaces. Co-extruded combinations form members with greatly improved resiliency and tensile/compression characteristics while benefitting from cost reductions. An exterior wall could be a resin with good temperature resistance properties and the inner wall a low cost filler resin.

Preferred extruded members include polyvinyl chloride, acrylonitrile-butadylene-styrene copolymers (ABS), polystyrene, polypropylene and glass reinforced fiberglass, metal pipe and tubing such as steel and aluminum. Also suitable are pipes made from paper/board and adhesives, resins and various plies of paper/board. They are typically referred to as "paper cores". Because of their simplicity and manufacturing they are wound to any inside and outside diameters very easily.

Thus, they can be tailored to fit standard plastic pipe fittings. The strength of the paper cores can be altered by customizing the resinous/adhesive binders as it is being wound. The exterior can be coated to make it weatherproof and waterproof.

DESCRIPTION OF THE PREFERRED EMBODIMENT(S)

Figure 1:
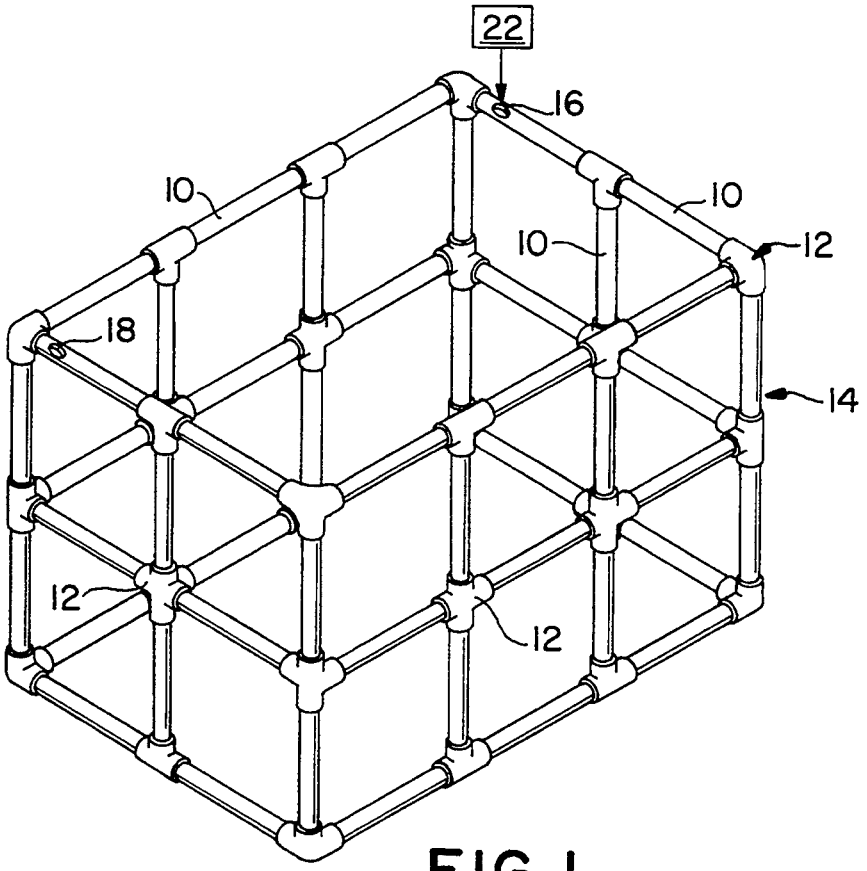
FIG. 1 is an illustration of a frame formed from members of the invention.

Referring to FIG. 1, a plurality of extruded PVC pipes or members 10 are joined together by standard fittings, generally designated as 12, to form a frame 14. The fittings and members are secured one to the other. Although a simple box-like shape is shown, any geometric configuration, rectangular, circular, etc., is within the scope of the invention. Further, based on the structural requirements, i.e. depending on the size of the finally assembled container and/or the amount of water the container will be expected to hold, the number of members used and their orientations will vary.

After the frame has been assembled, an opening 16 and a vent 18 are is formed in a top most member. A settable material 20, such as concrete, from a source 22 is pumped into the opening 16 filling the network defined by the hollow passageways of the members.

If the settable material is pumped in, then air is allowed to escape through the opening 18. Alternatively, a vacuum may also be applied on the opening 18 to enhance the filling of the hollow network of pipes.

Figure 2:
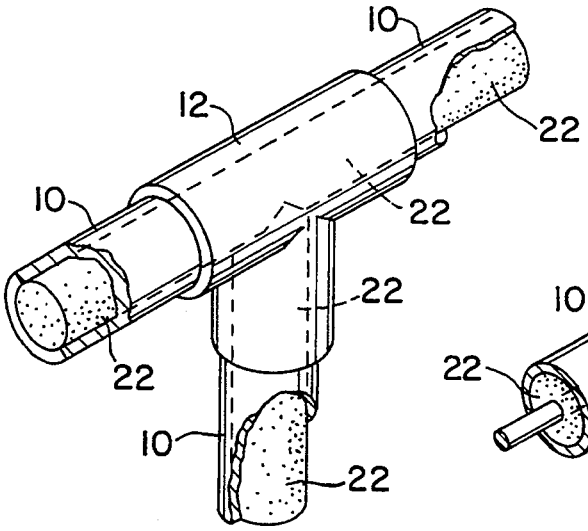
FIG. 2 is a section of FIG. 1 showing the filled pipes.

As shown in FIG. 2, both the member(s) 10 and the fitting(s) 12 are filled with the settable material 20.

Figure 3:
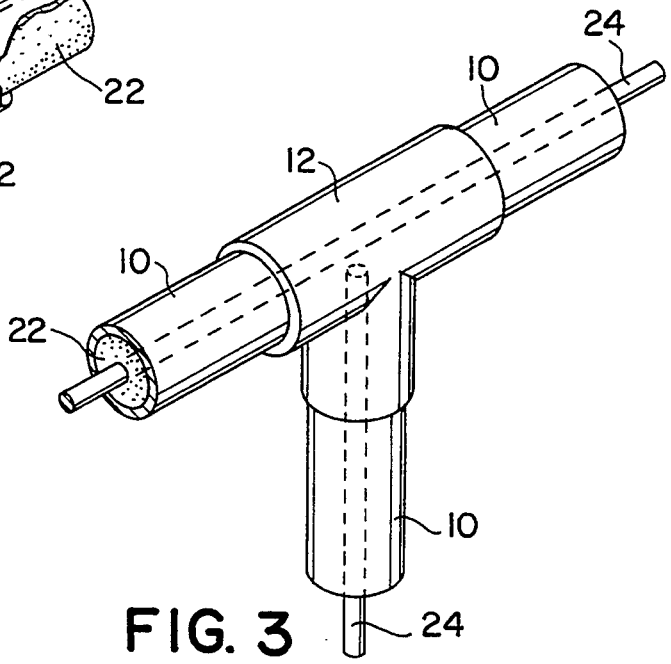
FIG. 3 is a perspective view of the section of FIG. 1 showing Re-bars in the members.

Referring to FIG. 3, in an alternative embodiment of the invention, Re-bars 24 are inserted in the passageways together with the material 22. This enhances the tensile and compressive strength of the frame. Other structural members of different geometric configurations such as disclosed in my '890 patent may be used in lieu of or in combination with Re-bars.

Figure 4:
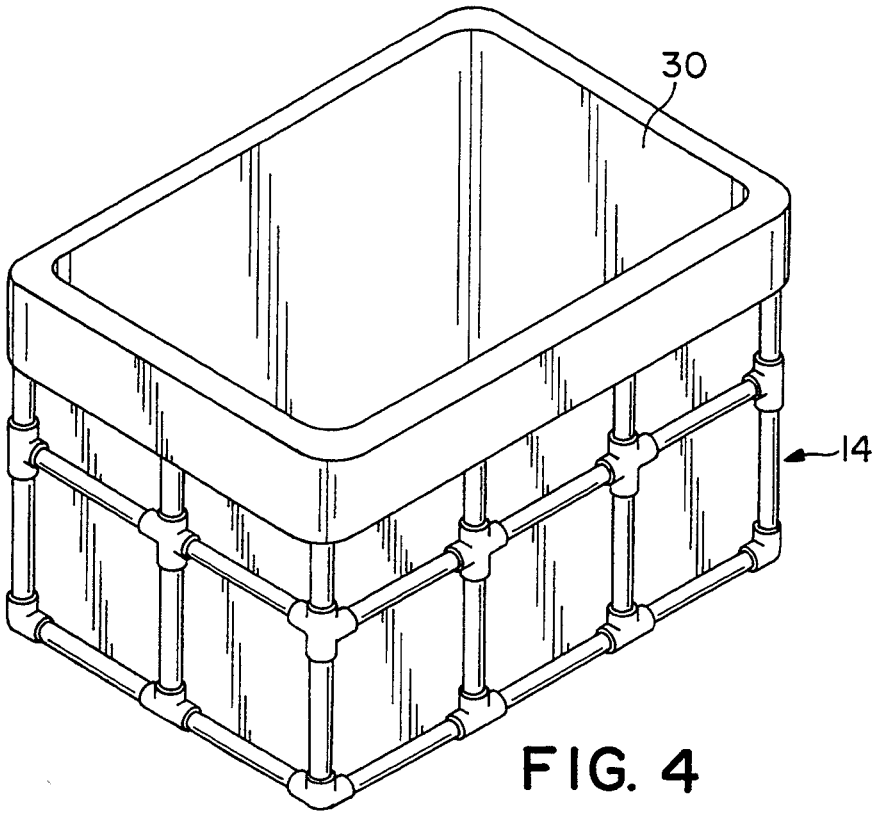
FIG. 4 is an illustration of the frame of FIG. 1 having a liner received therein.

Referring to FIG. 4, the frame of FIG. 1 has a liner 30 received therein, which liner extends over the upper edges of the frame. The liner, if desired, can extend to the bottom of the vessel. When the container is used as a water container, The liner will typically comprise a seamless polyethylene sheet 2 to 10 mils in thickness. The inner sheath is extended over the top edge and down to the bottom of the outside of the container. Thus, the inner sheath functions as both an inner and outer sheath. This outer sheath is wrapped with only a few layers of stretch film 5 to 10 mils to complete the overall wrapping.

Figure 5:
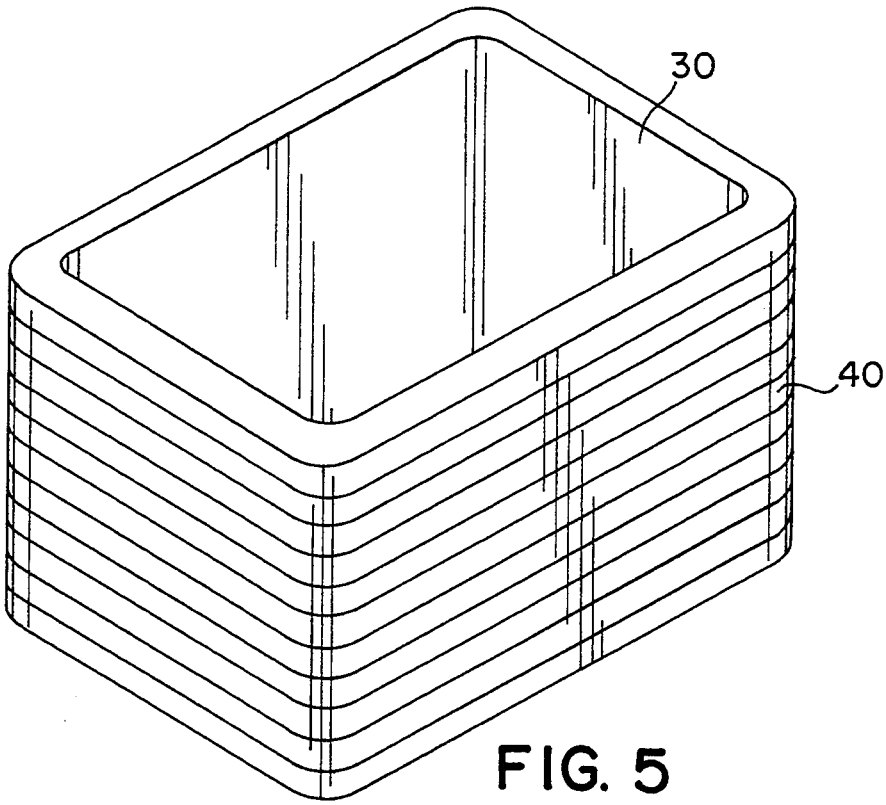
FIG. 5 is an illustration of the liner-frame of FIG. 4 having an outer wall wrapped thereon.

Referring to FIG. 5, the container is wrapped with stretch film 40. The actual technique of wrapping is not a part of the invention. Any wrapping techniques including spiral wrapping techniques known to those skilled in the art for wrapping rectangular, semi-circular, circular containers, pipes and the like with a plurality of films, webs, ribbons and the like may be used. One of the factors considered in selecting the films of the container disclosed herein, and particularly for the liner film, is to use resins which will not affect the taste of the stored water.

Preferably, stretch film is wound around the outside surface of the frame with a variable number of layers which will be determined by the ultimate size of the container. The larger vessel is, the more water it will hold and therefore greater wall strength will be required. That is, the greater the weight, the greater will be the thickness of the film wall. The stretch films slightly tacky surface will make a soft, strong and resilient barrier. Thus, the wrapping may be left intact as such and become the finished container.

When the frame 10 is wrapped to the desired degree, the carrier film is severed and the trailing edge of the carrier film is fused or adhered, such as with epoxy adhesives, to form a wall seal.

Figure 6:
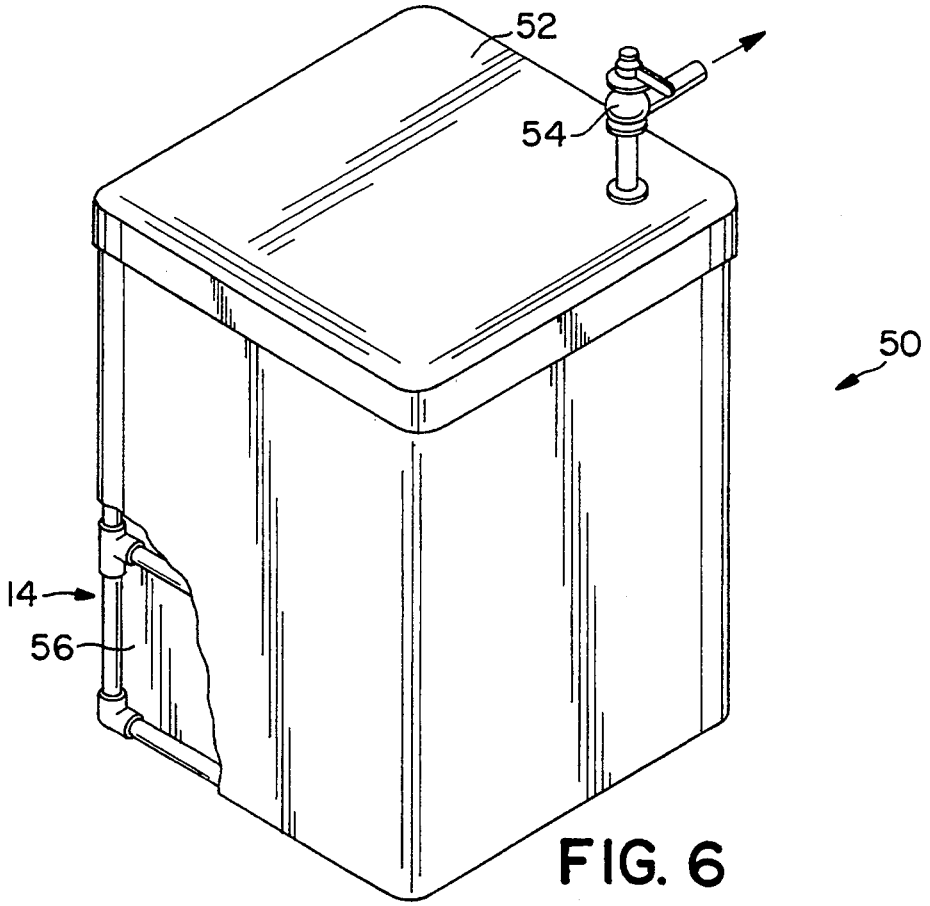
FIG. 6 is an illustration of a container structured as a digester.

Referring to FIG. 6, a digester 50 of the invention is shown with a cover 52 which includes a conduit 54 to collect the off (methane) gases generated.

The preferred embodiment has been described wherein the stretch film is high density, high molecular weight polyethylene. An equally preferred embodiment is where the film is PVC stretch wrap.

The liner 56 is typically 20 to 80 mils of high density or ultra-high density or high molecular weight polyethylene which is typically used in the so-called geo-membrane industry (land fill liners). If the liner is extruded, it is first rolled and butt-welded into a cylinder and then butt-welded at the bottom to form the liner. If it is extruded as tubing, butt-welded seals at the bottom are all that are needed. The outer liner is the same as the inner liner as described in FIGS. 1–5, namely, it extends over the upper edge and down the outer wall to the bottom of the container. Alternatively, in this embodiment, as the digester is assembled upwardly, it is spiral wrapped with stretch film or thin gauge, high density polyethylene or polyurethane while being sprayed with polymerizable coatings as noted in my U.S. Pat. No. 5,022,555.

Figure 7:
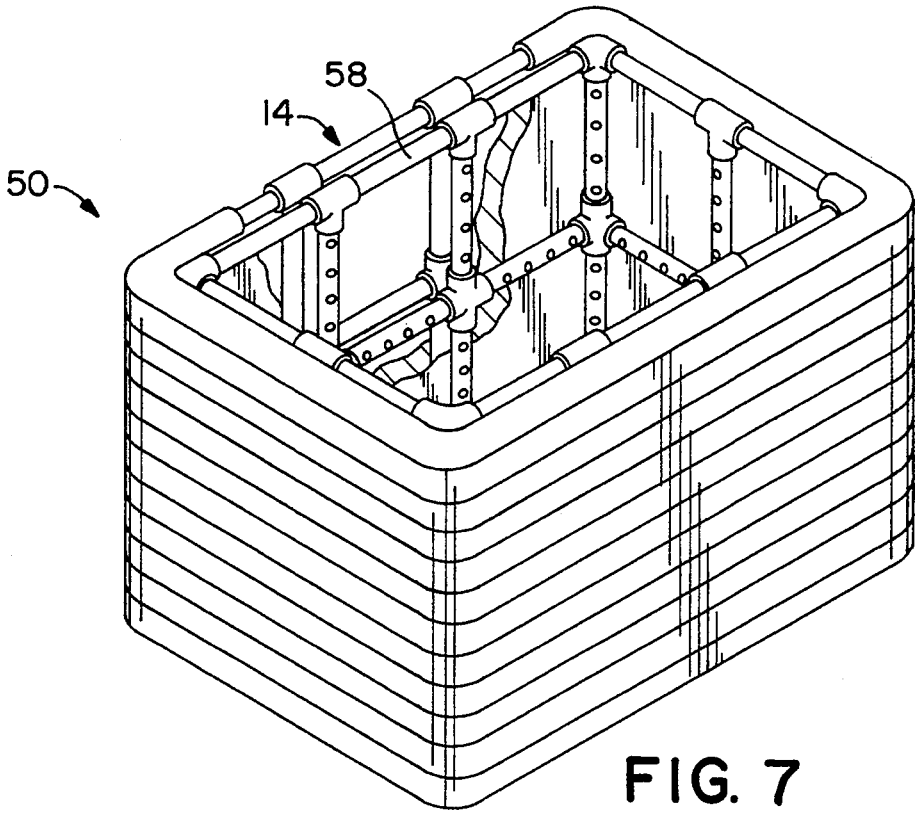
FIG. 7 is an illustration partly broken away of an auxiliary grid system used with the digester of FIG. 6.

As shown in FIG. 7, for the large size vessels, such as the digester, which uses the very heavy gauge liner, the liner is secured to the inside of the frame by the use of a secondary inside frame 58 of grid-like members, such as described for FIGS. 1–5, which grid is parallel to and concentric with the outer frame. This results in the heavy liner being suspended and sandwiched between the inner and outer frames. This inner frame is further characterized by at least some of the members being hollow and having flow passages therein whereby gases and/or liquids can be injected into the land fill mass to catalize its decomposition.

Another application of the two frame concept is the use in horizontal underground storage tanks for gasoline, petroleum hydrocarbons or other liquids. With the invention, it is simply a matter of choosing the most suitable plastic film liner to make it impermeable. In practice, such a tank may or may not have the exterior stretch film shield with the polymerizable coatings for super resistance to leakage. The structures described heretofore can easily be employed in buildings, housings, dwellings, shelters, tables, shelves, benches, etc.

Figure 8:
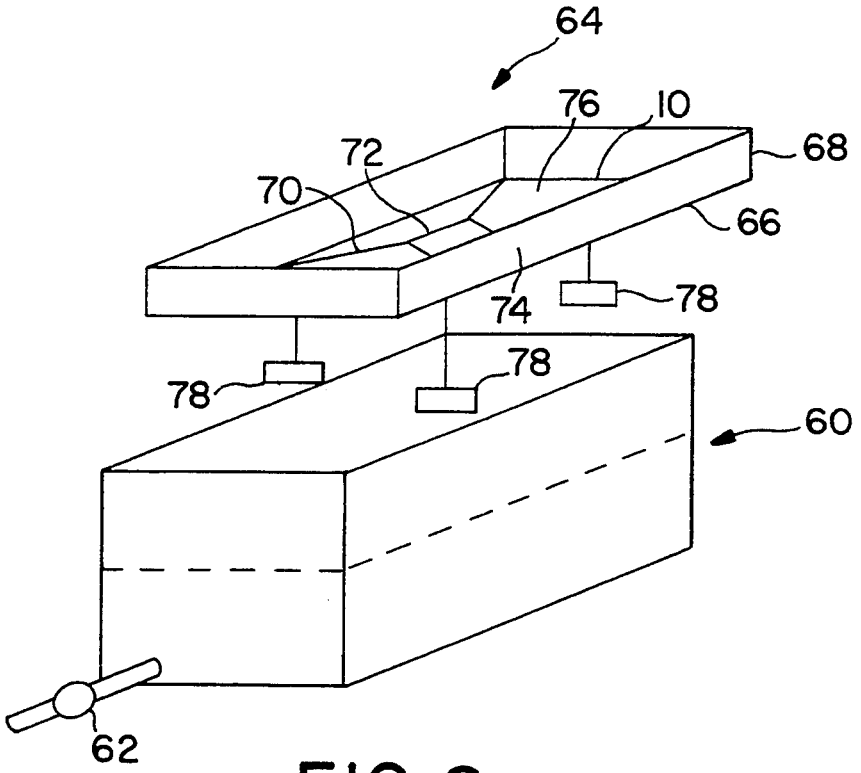
FIG. 8 is a schematic of a vessel used for the storage of potable water together with a cover.

Referring to FIG. 8, a container 60 is shown which is similar in structure to the container shown in FIG. 4. The container 60 includes a valve 62 for the removal of potable water from the container. The container 60 includes a cover shown generally at 64. Members 10 define a rectangular frame 66. Extending upwardly from the frame 66 at the corners thereof are posts 68. Members 70 extend inwardly and downwardly from the bottoms of the posts 68 and are joined at their depending ends to the corners of a small frame 72. The entire cover is wrapped with stretch film 40. The members 10, vertical posts 68 and depending members 70 can or cannot be filled with settable material as desired. After the cover is wrapped, it defines walls 74 and a floor 76 which slopes downwardly and inwardly. The frame 72 is not wrapped and defines a screened opening in the floor as formed. Received within the double-walled sides 102 and 104 are two pipes forming a V 110. These V-shaped pipes 110 reinforce the parallel frames. This allows rain water or water to flow into the container 60 while minimizing evaporative losses. The cover 64 can be secured to the upper edge of the vessel 60 in any suitable manner, such as with adhesives, wrapping, bolting, clamping, etc.

Depending from the members 70 to aid in the disinfection of water are time-release, porous-walled packages with perforated cylinders of anti-microbial materials 78 to be disposed in the water at various depths as shown to ensure that the water will remain pure at the different levels. The packages, such as activated charcoal or chlorine-emitting types or other bacteriacidal compounds known to be effective in the disinfecting water are used. Further, treated or untreated Bentonite clay with silver compounds, such as colloidal silver or silver salts, can be used. Lastly, solids that generate oxygen when immersed in water, such as sodium perborate and similar compounds, can be used. Packets containing ion-exchange resins may be used to reduce sodium levels in brackish water to make it drinkable.

The embodiment of FIG. 8 can be adapted as a latrine or toilet. For example, an opening could be made at the top and an adjustable and portable seat is positioned on top of it. In this way, the potable unit also functions as a digester.

Figure 9:
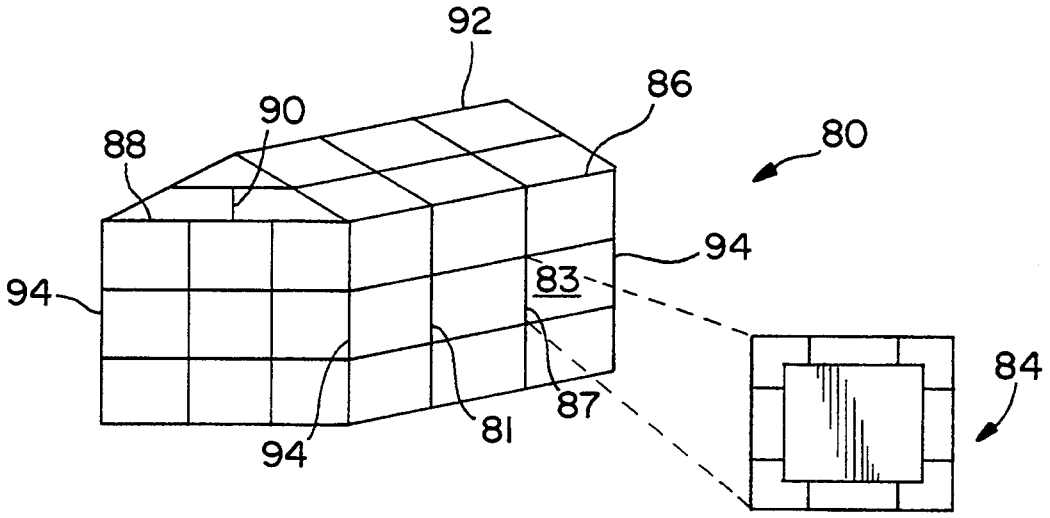
FIG. 9 is a schematic of a frame of the invention used as a shelter.
Figure 16:
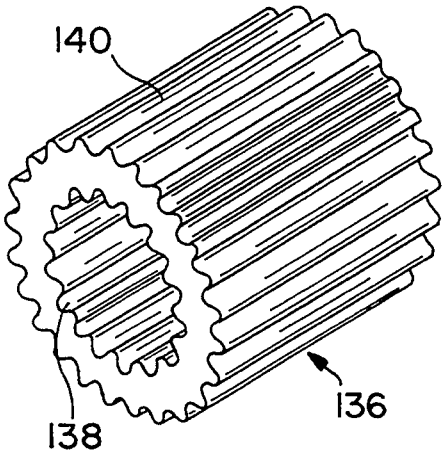
FIG. 16 is a pipe with both interior and exterior grooves.

Referring to FIG. 9, a house-like structure 80 is shown. The structure 80 is formed from members 81 joined by fittings. The members are filled as previously described. The members form panel-like openings 82 in which are secured panels 84. The wall plates 86, tie beams 88, king posts 90, ridge pole 92, and corner posts 94 are preferably multiple member combinations of pipe, separator and tensional wrap such as shown in FIG. 16.

The remaining structural members 81 are typically single members.

The panels 84 comprise filled member joined by fittings which panels are wrapped with either clear (window) or opaque (walls) plastic wrap. The panels 84 are frictionally and/or adhesively secured within the openings defined by the members of the structure 80.

Figure 10:
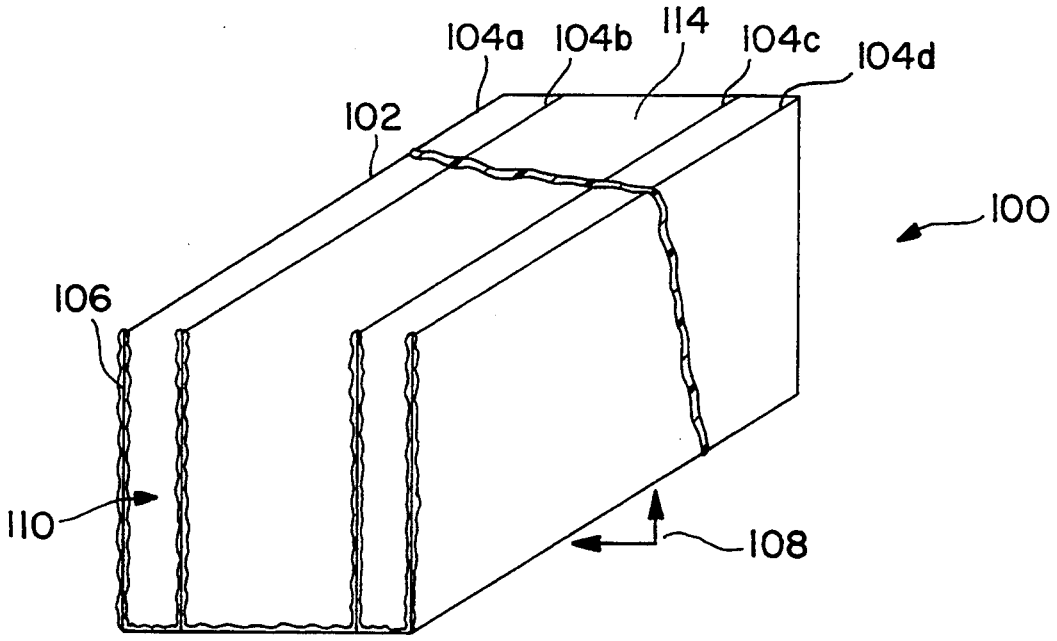
FIG. 10 is a schematic of a channel formed according to the invention.

Referring to FIG. 10, a channel-like structure is shown generally at 100 and the channel can be used such as for a water line, sewer line or rain-harvesting line. The channel comprises double-walled sides 102. The double walls 102 each comprising panels **104*a*, 104*b*, 104*c* and 104*d* formed of members as previously described. The members are joined together by suitable fittings. A liner 106 is received within the channels and walls and viewing FIG. 10 from left to right extends along the outside surface of the outer wall 104*a*, down the inner surface of the wall 104, across the floor defined by the two walls 104*a*, up the outwardly facing side of the inner walls 104*a*–104*b*, down the inwardly facing side of the wall 104*b*, across the floor 106 of the channel 100, upwardly across the inwardly facing surface of the wall 104*c*, down the outwardly facing surface of the wall 104*c*, across the floor defined by the walls 104*c* and 104*d*, upwardly across the inwardly facing surface of the wall 104*d*, and downwardly across the outwardly facing surface of the wall 104*d*. The liner, in effect, creates a triple U-shaped membrane barrier. The channel may also be characterized by spaced valves 108 for withdrawing liquid from the channel. The twin parallel pipe frames, as previously described, are fabricated from cement filled pipe and/or fittings. The channels defined by the walls 104** can act as an insulating barrier or a protective liner for the principle channel. The floor of the channel uses structural members as previously described as needed. Depending upon its use, one end or both ends of the channels may be sealed.

Additionally, a cover 114 is shown schematically (with or without disinfecting packets to close the top of the channel. The cover drapes over the sides of the channel.

In a particularly preferred embodiment grooved members are used.

Figure 11:
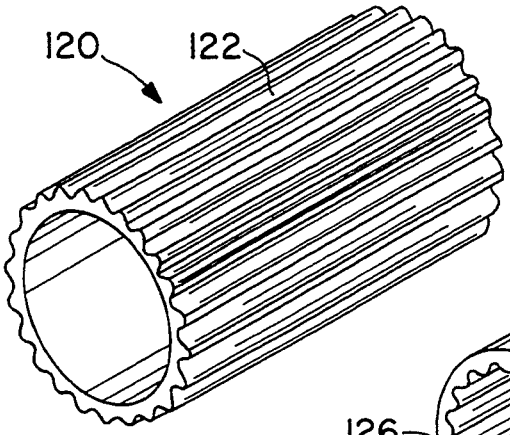
FIG. 11 is a schematic of a pipe with exterior grooves.

Referring to FIG. 11, a member is shown generally at 120 having a grooved exterior surface 122.

Figure 12:
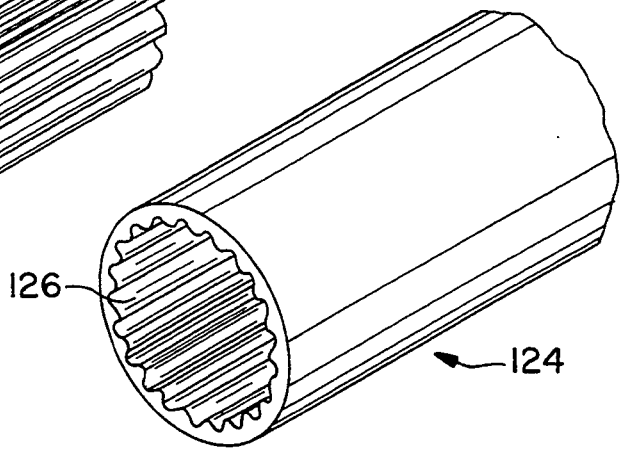
FIG. 12 is a schematic of a pipe with interior grooves.

Referring to FIG. 12, a member 124 is shown having a grooved inner surface 126.

Figure 13:
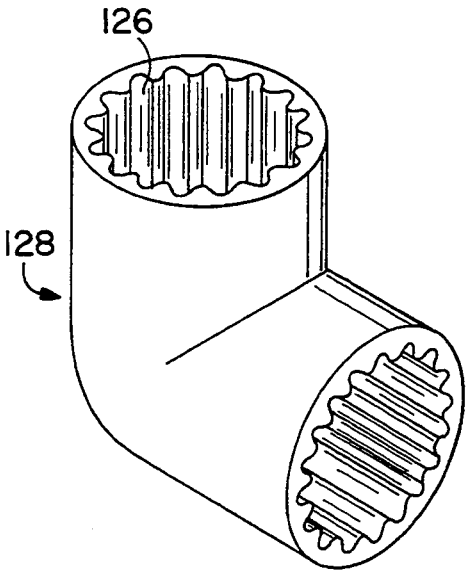
FIG. 13 is a schematic of a fitting with mating grooves for the pipe of FIG. 1.

Referring to FIG. 13, a fitting 128 is shown having a grooved inner surface 130, the grooves of which are adapted to mate with the grooves 122 of the member 120.

Figure 14:
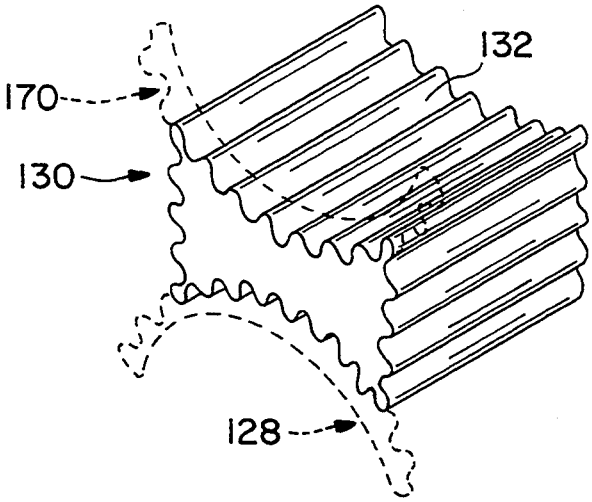
FIG. 14 is a separator adapted to engage pipes such as shown in FIG. 8.

When joining two or more pipes together, such as the members 120, as shown in FIG. 14, a concave separator 132 having grooved surfaces is used.

Figure 15:
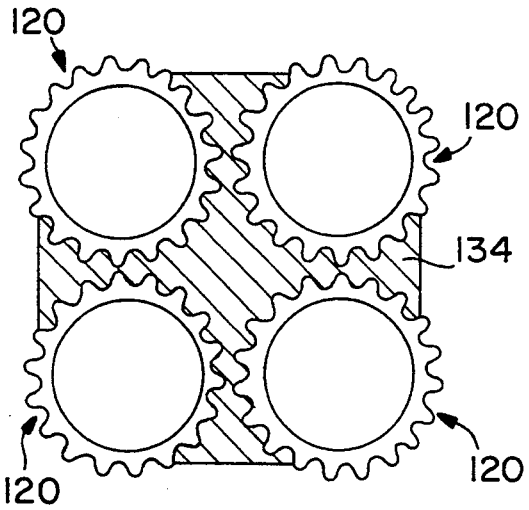
FIG. 15 is a four-pipe beam with matching separators.

To form a beam or the like a four-sectioned concave separator 134 is used as shown in FIG. 15.

Referring to FIG. 16, a member 136 has an inner grooved surface 138 and an outer grooved surface 140 is shown. When the hardener material is introduced into the member 136 the greater surface area of the peaks and valleys of the grooves allows the introduction of more hardening material to create additional strength as it flows through the clearances.

Not only do the members with grooves add strength but the fittings and the concave separators groove to match the member groovings also add total strength of the various combinations. Two, three and four members with appropriate concave separators in intimate contact with each other are then wrapped under substantial tension with wire or polypropylene strapping.

Figure 17:
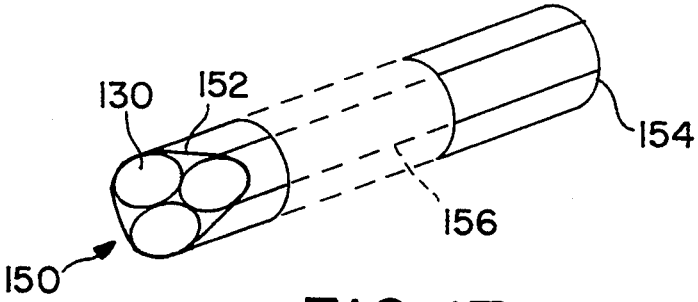
FIG. 17 is a schematic of a beam of the invention.

Referring to FIG. 17, a three membered beam 150 is shown with members 120 joined to a ground separator 152. The beam is wrapped with straps 154 and then coated with cement 156. This construction will allow the fabrication of structural building elements or beams that can be customized to fit any construction purpose. Therefore, it will be apparent to one skilled in the art that there are a wide choice of arrangements that are possible with the concept of grooving. The use of the hardening material and the variety of members, fittings and separators, a very broad range of cost effective units is possible. Also, two members with grooves and separator can handle loads that would be impossible with two smooth wall pipes of the same diameter.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention, what I now claim is:

1. A structure which comprises:

a plurality of hollow members joined one to the other by hollow fittings, the hollow fittings and members defining frame having a network of hollow passageways;

a settable material filling the hollow network of passageways and functioning in combination with the members and the fittings to impart superior structural strength to the members and thereby the frame;

an open topped impermeable liner received within the frame, the liner having upper edges which extend over at least a portion of the outer wall of the frame; and an open topped outer wall comprising a plurality of layers of substantially self-adhering polymeric film, wherein the frame comprises a first outer frame and which comprises a second inner frame, the liner between and supported by the inner and outer frames.

2. The structure of claim 1 wherein the hollow members are extruded and have an exterior wall which is distinct from an concentric inner wall.

3. The structure of claim 1 wherein reinforcing members are received within the hollow members and held in place by the settable material.

4. The structure of claim 1 wherein at least some of the members of the inner frame are hollow and permeable.

5. The structure of claim 1 wherein the filling materials are selected from the group consisting essentially of hardener filler materials include polymers, such as phenolics, urea-formaldehyde, styrene, styrene copolymers, acrylics, urethanes, vinyl s, foams, aerated cement, concrete, wood flour mixes, synthetic or natural rubber, latex, molten rubber, molten sulphur, mixture of the combination of rubber or rubber modified products with sulphur or other vulcanizing agents.

6. The structure of claims 1 wherein the reinforcing rods are selected from the group consisting essentially of steel re-bars or poltruded glass fiber bundles.

7. The structure of claim 1 wherein the extruded members are selected from the group consisting essentially of polyvinyl chloride, acrylonitrile-butadiene-styrene copolymers (ABS), polystyrene or polypropylene, paper cores and glass reinforced fiberglass or metal tubing.

8. The structure of claim 1 wherein the outer surfaces of at least some of the members are grooved and said members are joined by mating grooved hollow fittings.

9. The structure of claim 8 wherein the members are characterized by inner and outer grooves.

10. The structure of claim 8 which comprises a grooved mating separator joined to the members.

11. The structure of claim 10 which comprises: means to wrap the members under tension.

12. The structure of claim 11 which comprises: a hardening material coated on the members and separator.

* * * * *